United States Patent [19]

Merrill

[11] 4,265,645

[45] May 5, 1981

[54] INJECTOR TYPE COOLING TOWER HAVING AIR DISCHARGE SLOTS

[75] Inventor: Richard P. Merrill, Columbia, Md.

[73] Assignee: Baltimore Aircoil Co., Inc., Jessup, Md.

[21] Appl. No.: 114,000

[22] Filed: Jan. 21, 1980

[51] Int. Cl.[3] ..... B01D 47/06

[52] U.S. Cl. ..... 55/257 PV; 55/342; 261/116; 261/DIG. 11

[58] Field of Search ..... 55/257 PV, 410, 342; 261/116, DIG. 11

[56] References Cited

U.S. PATENT DOCUMENTS

| | | | |
|---|---|---|---|
| 2,403,841 | 7/1946 | Baird | 261/DIG. 11 X |
| 2,852,239 | 9/1958 | Vicard | 55/257 PV X |
| 3,807,145 | 4/1974 | Engalitcheff, Jr. et al. | 55/257 PV |
| 3,812,656 | 5/1974 | Barnhart | 261/116 X |
| 3,922,153 | 11/1975 | Engalitcheff, Jr. et al. | 55/257 PV |

FOREIGN PATENT DOCUMENTS

| | | | |
|---|---|---|---|
| 382402 | 10/1923 | Fed. Rep. of Germany | 261/116 |
| 937830 | 9/1963 | United Kingdom | 55/257 PV |
| 301448 | 7/1971 | U.S.S.R. | 55/257 PV |

*Primary Examiner*—Kathleen J. Prunner

*Attorney, Agent, or Firm*—Michael C. Sudol, Jr.; Harry E. Westlake

[57] ABSTRACT

An injector type cooling apparatus is disclosed wherein multiple flat liquid sprays are directed into a conduit of uniform cross-section to draw cooling air into and through the conduit for mixture with and heat transfer from the liquid. The discharge end of the conduit is fitted with mist eliminators, in addition, holes or slots fitted with mist eliminators are provided in the conduit roof or sides downstream of the liquid sprays. These holes or slots cause increased air flow which results in improved cooling apparatus performance.

5 Claims, 3 Drawing Figures

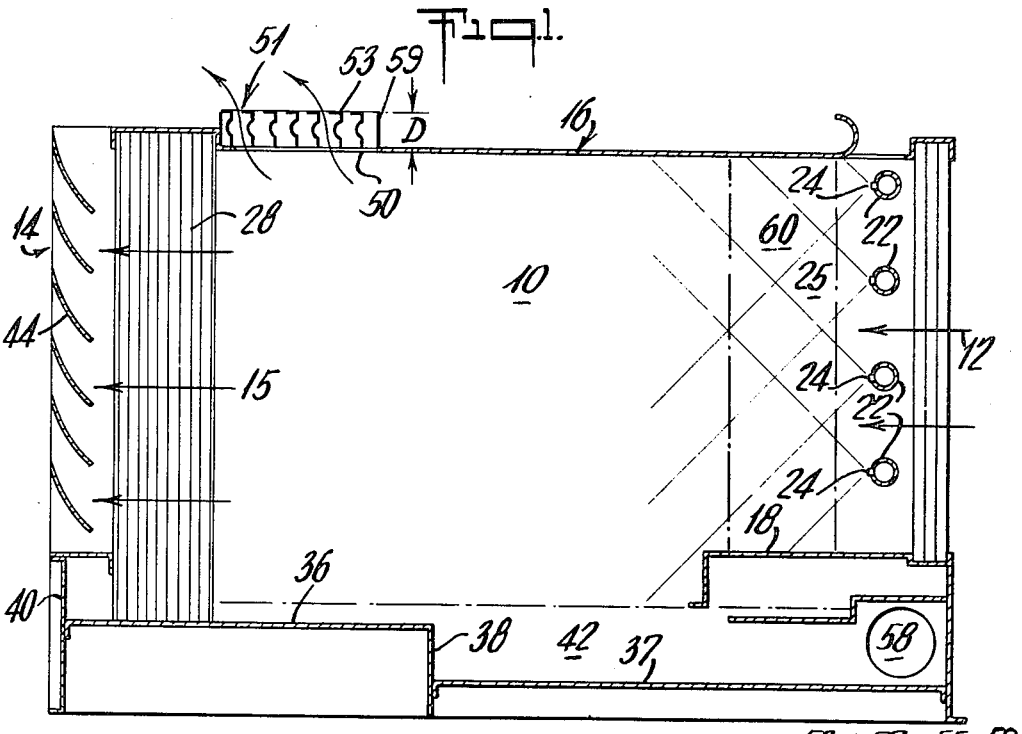
Fig.1.
51
53
59
D
50
16
14
28
44
15
10
60
24
22
25
12
18
36
40
38
42
37
58
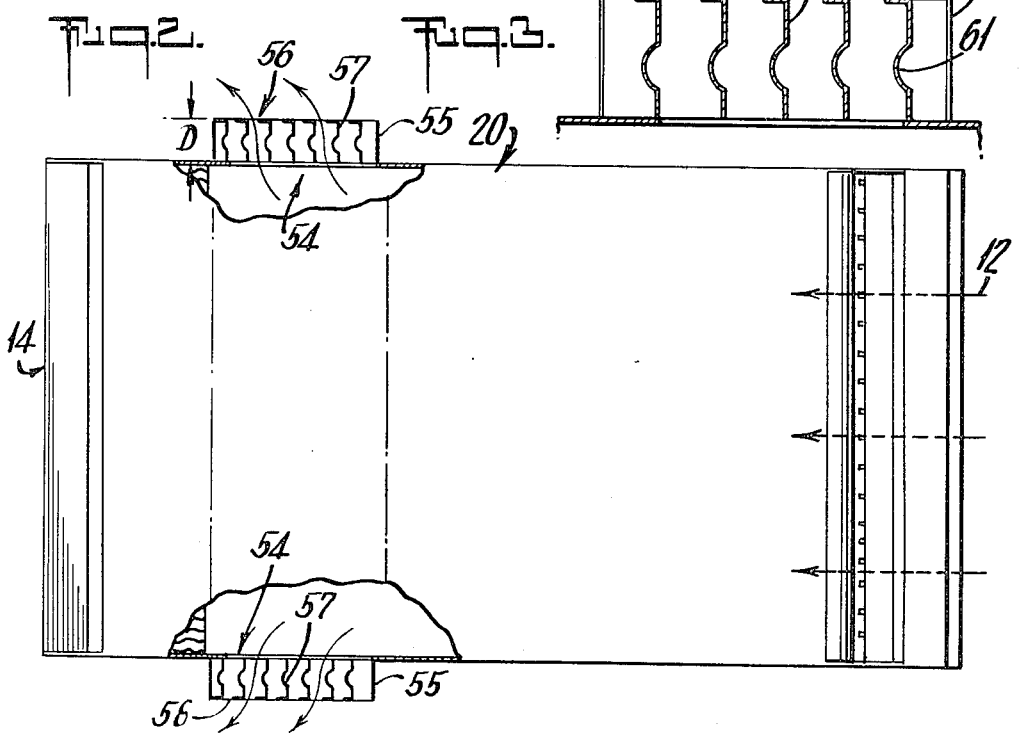
Fig.2.
Fig.3.
56
57
D
55
20
54
14
12
53 or 57
55 or 59
61

INJECTOR TYPE COOLING TOWER HAVING AIR DISCHARGE SLOTS

BACKGROUND OF THE INVENTION

1. Field of the Invention

This invention relates to injector type cooling towers in which a liquid to be cooled is sprayed into a conduit to induce air flow through the conduit along with the liquid. These devices are sometimes called ejector type cooling towers. More specifically, the invention is concerned with novel arrangements for increasing air flow through the conduit, thus improving performance by having improved heat rejection and lower water temperatures.

The novel arrangements of this invention consist of opening part of the roof or sides of an injector type cooling unit, and installing a mist eliminator section over the hole. This will improve the tower performance by increasing the airflow through the unit. The airflow is increased because a portion of the exhaust air will pass out through the holes or slots. This increased airflow will result in improved heat rejection and lower water temperatures of the cooling unit.

2. Description of the known Prior Art

Injector type cooling towers in which the present invention may be used are shown and described in U.S. Pat. No. 3,807,145 which issued Apr. 30, 1974. As shown therein, water to be cooled is sprayed via a plurality of nozzles into a conduit open at both ends to the atmosphere. The spray induces atmospheric air into the conduit in admixture with the water. The air cools the water by both sensibe and evaporative heat transfer. The air and water are separated at the downstream end of the conduit by means of curved liquid-air separator strips which intercept the water droplets and increase their gravity component so that the water flow down along the strips to a recovery sump below them.

In U.S. Pat. No. 3,922,153 there is shown an inlet air stabilization slot in conjunction with an injector type cooling unit. However, this slot is primarily used for inlet air stabilization and is upstream of the pumping and pressurization effect of the nozzles. In this invention, however, the holes or slots provided in the conduit roof or sides are downstream of the pumping effect or pressure region of the sprays.

SUMMARY OF THE INVENTION

According to a first aspect of the present invention there is provided, in an injector type evaporative cooling device, an air flow hole or slot in the roof and/or sides of cooling device downstream of the nozzles or pumping effect and downstream of the effective high pressure region of the sprays. The hole or slot is fitted with an eliminator to strip out the water from the air-water mixture passing therethrough. Preferably the nozzle sprays are of essentially flat, fan shaped configuration. Further, in the preferred embodiment the eliminator strips are corrugated to strip maximum water from the air passing therethrough.

The thermal capacity, that is the heat rejection ability of the unit is increased 10 to 20% (depending upon operating temperature and pressure conditions) over units without the hole or slot. This means that the unit of this invention will cool more water at the same temperatures or, cool the same amount of water at lower temperatures with respect to the ambient wet bulb temperature.

There has thus been outlined rather broadly the more important features of the invention in order that the detailed description thereof that follows may be better understood, and in order that the present contribution to the art may be better appreciated. There are, of course, additional features of the invention that will be described more fully hereinafter. Those skilled in the art will appreciate that the conception on which this disclosure is based may readily be utilized as the basis for the designing of other arrangements for carrying out the several purposes of the invention. It is important, therefore, that this disclosure be regarded as including such equivalent arrangements as do not depart from the spirit and scope of the invention.

BRIEF DESCRIPTION OF THE DRAWINGS

Various embodiments of the invention have been chosen for purposes of illustration and description, and are shown in the accompanying drawings, forming a part of the specification, wherein:

FIG. 1 is a side view, taken in center section of an ejector type water cooling system in which the present invention is embodied;

FIG. 2 is a top plan view of the water cooling system of FIG. 1 having slots on the sides thereof rather than on the top;

FIG. 3 is a detailed view of a typical mist eliminator strip shown in FIG. 1 or 2.

DESCRIPTION OF THE PREFERRED EMBODIMENTS

The injector type cooling tower of FIGS. 1 and 2 comprises a conduit 10 formed of sheet material and having a generally rectangular cross-section of uniform dimensions throughout its length. The conduit 10 has an air inlet end 12 and an air outlet end 14 both open to the atmosphere. Between these two ends, the conduit 10 is made up of a top wall 16, a bottom spray seal plate 18 and the horizontal extension thereof, and side walls 20.

A plurality of water supply manifolds 22 extend parallel to each other horizontally across the conduit interior near the air inlet end 12. Water to be cooled is pumped by external means (not shown) to these manifolds. A plurality of spray nozzles 24 are provided at spaced apart locations on each of the manifolds 22 and these spray nozzles are aimed to project sprays of water 25 into the conduit 10 toward its air outlet 14.

The water sprays 25 from the nozzles 24 are of generally flat, fan shaped configuration. That is, the sprays diverge much more extensively in the vertical direction than in the horizontal direction. As pointed out in previously mentioned U.S. Pat. No. 3,807,145, this serves to maximize cooling and air entrainment. The nozzles of each conduit are aligned with corresponding nozzles in the other conduits.

Also as shown in FIGS. 1 and 2, there are provided a plurality of spaced liquid-air separator strips 28 near the air outlet end of the conduit 10. These separator strips also are of sheet material and they are positioned to lie in vertical planes distributed across the conduit cross-section The lower water collection shelf 36 is supported a short distance above a bottom wall 37 by vertical walls 38 and 40. A sump 42 is formed immediately below the conduit 10. The lower extent of the sump is defined by the bottom wall 37 and the lower water collection shelf 36, and the upper extent is defined by the level of the water contained therein. The sump has an outlet opening 58 from which the cooled water can be removed and used for whatever purpose necessary.

A plurality of curved turning vanes 44 extend horizontally across the conduit 10 downstream of the liquid-air separator strips 28. These turning vanes are curved upwardly from the horizontal; and they serve to deflect moisture laden air exiting from the conduit 10 up and away from the conduit so that it cannot be recirculated back into the inlet end 12. It will be appreciated that these turning vanes are open to the atmosphere and that no special protective structures such as scoops, baffles or the like, are used.

In FIG. 1 there is shown a slot 50 extending across or in fact partially across the top wall 16 of the conduit 10. This slot is shown located downstream of the pumping effect and pressurization effect 60 of the sprays 25 (in this case near the liquid-air separator strips 28). This is the optimum position of the slot 50. Although the slot can be located anywhere along the conduit as long as its position is downstream of the pumping and pressurization effect 60 of the sprays 25, the closer it is located to this pumping and pressurization effect of the sprays 25 (the pumping and pressurization effect of the sprays 25 is shown as a Zone 60), the less efficient the injector type cooling tower becomes.

Similarly in FIG. 2 there are shown slots or holes 54 on each side of the side walls 20 of the conduit 10. These slots 54 are generally vertical and extend from the top of the conduit 10 near top wall 16 to just above the water collection shelf 36. The same reasoning as for top slot 50 applies to these slots 54 regarding their location on side walls 20. One skilled in the art will realize that any combination of slots 50 and 54 can be utilized, for example, one can only use top slot 50 or only side slots 54 or both top and side slots together in any particular application.

Each slot or opening 50 and 54 can be fitted with mist eliminators 51 and 56. These eliminators which can be metal strips 53 and 57 are fitted adjacent the slots or holes 50 and 54 such as by inserting a bank of the strips into a holding element 55 or 59. A shown in FIG. 3 these eliminators 51 and 56 can be strips 53 or 57 which have bends 61 or corrugations therein. Each strip can also be positioned close to each adjacent strip so that in effect the strips are in nesting relationship with each other.

It will be appreciated that the liquid-air separator 28 must be quite deep in the air trend direction 15 because they have spray water directly impinging upon them. It has been found, however, that the top or side mounted mist eliminators or liquid air separators 51 and 56 do not have to be as deep (deep meaning the dimension shown by D in FIGS. 1 and 2) because spray water is not sprayed directly thereon. These shallower air-liquid separators 51 and 56 offer less resistance to air flow than the main liquid air separator 28.

Any water stripped from the air flowing through top slot 50 by air-liquid eliminator 51 will fall down to bottom wall 36 and eventually go to sump 42. In order to catch the liquid stripped from the air leaving slots 54 one can attach a basin 56 (not shown) at the bottom of the air-liquid separator bank to catch the liquid and lead it to bottom wall 36 whereby it will eventually be led to sump 42.

In operation of the system, water to be cooled is pumped into the water supply manifolds 22 and is sprayed out through the nozzles 24 into the conduit 10. These sprays, as pointed out above, are of generally flat, fan shaped configuration lying in parallel vertical planes. The sprays from the different nozzles intersect with each other downstream of the nozzles and the outermost sprays contact the conduit walls in the same region so that there is formed a pumping effect or pressure seal 60 across the conduit cross-section. The momentum of the sprays causes air to be drawn in the air inlet 12. This air is thoroughly mixed with and is carried along by the sprays as they pass through the conduit. At the downstream end of the conduit the air and water are separated as the water impinges upon and flows down along the surface of the strips 28 while the air continues to flow out between them.

The amount of water sprayed through the nozzles is varied by changing the pressure in the manifolds 22. The amount of water sprayed through the nozzle is also varied by changing the size of the nozzle orifices. The amount of variation which can be accepted for the particular nozzle arrangement is limited by the ability of the liquid-air air separator means 28 to provide effective operation with minimal liquid loss due to overflooding. Under conditions of operation where the liquid-air separator strip means become overflooded, it is advantageous to use two or more banks of liquid-air separator strip means each having its own water collection shelf and by-pass opening toward the lower sump as described in U.S. Pat. No. 3,922,153.

As the air and water move together through the conduit, the air absorbs heat from the water through latent heat transfer. Also, where the ambient dry bulb temperature is low enough, a cooperative sensible heat transfer also takes place. In such case, because of the physical contact between the air and water, the air is heated to a higher dry bulb temperature which enables the air to hold more moisture before becoming saturated. Thus, an increased portion of the sprayed water can evaporate into the air so that the water becomes further cooled. The construction and arrangement of the conduit 10 is such as to obtain a substantial volume rate of air flow while maintaining a high relative velocity between the cooling air and the sprayed water, with corresponding high heat transfer between the two. Also, near the outlet end a high relative velocity is obtained by virtue of the crossflow relationship of the horizontally moving air and the downwardly flowing water on the liquid-air separator strips 28.

The cooled water which has flowed down the upper and lower banks of liquid-air separator strips 28 an onto the lower water collection shelf 36 passes over the edge of the shelf into the sump 42. This water then flows back along the sump and through an optical strainer (not shown) where is is cleaned of any solid particles which may have been entrained during contact with the atmospheric air drawn into the system. After passing through the strainer, the cooled water passes out of the device via the water outlet port 58.

The ability of the device to cool water is dependent upon its ability to move through the conduit 10. In general, the greater the airflow, the greater the heat rejection rate. Thus, the object of such an invention is to induce as much fresh air as possible through the conduit 10.

The airflow rate is a function of two things: First, the air movement is caused by a transfer of momentum from the spray water 25 to the air. The momentum of the water is generated at the expense of pump horsepower. For any particular design, the more pump horsepower that is available, the more airflow and, therefore, more heat rejection will be achieved.

Secondly, the efficiency of the water to air momentum transfer is a result of careful design. In order to achieve maximum efficiency, the airflow through the conduit must be unrestricted as possible.

The liquid-air separator strips 28 are the most significant restriction to airflow. The separator strips are constructed and positioned with respect to each other in such a manner as to provide an efficient path for air-water separation. In transversing the separator section, the air-water mixture is required to make several changes in direction. The water droplets, having more inertia, do not change direction as quickly as the air. They impinge upon the separator strips and having lost their momentum—in the direction of the airflow—are free to fall by gravity into the collection basin. The more tortuous the path of the air-water mixture, the more efficient it is at stripping the water from the air. However, the more tortuous the paths, the more restrictions to airflow are produced. Thus, separator strip design is a careful balance of minimizing air resistance while maximizing water separation.

Previous separator strip designs experience performance limitations as a result of high airflow or waterflow or both in combination. Too high an airflow (i.e., high discharge velocity) will strip droplets from the surface of the separator strips and carry it outside the device. Too high a waterflow impinging upon the separator strips will cause water to accumulate between the strips faster than it can drain into the sump 42. This excess water will bridge the spaces between the strips and partially obstruct the passage of air through the conduit until internal pressure builds to the point that water is blown out the discharge. For previous designs, the combination of air and waterflows that cause these performance breakdowns or mist carry over are well known. Also, traditionally, the liquid-air separator sections have been limited in location to the plane of the discharge end of the conduit.

By properly sizing the slots 50 and 54, the effective discharge area of the conduit 10 has been increased without increasing the overall volume of the device. However, this is *not* simply a discharge area increase. The liquid-air separator strips 53 and 57 for the slots 50 and 54 have an advantage in that they are not directly impinged upon thr spray water and, as a result, can be much more shallow and less restricting to airflow. Therefore in operation, the quantity of air passing through the slots is higher than the quantity of air which would pass through the slots on the basis of the proportion of slot area to the total discharge area. Also, the liquid-air separator strips 28 are partially relieved of the task of handling both high airflow and waterflow. Reduction in their air-flow allows an increase in waterflow while still not reaching the mist carry over point.

What has been accomplished by this invention is a certain degree of specialization of the separator strips—one set 28 is good at handling the high waterflows, while the others 53 and 57 are good at handling high airflow rates. This specialization resulted in increased total airflow, increased heat rejection capacity and reduced overflooding of the liquid-air separator strips 28 with no increase in pump input horsepower or unit size.

Although certain particular embodiments of the invention are herein disclosed for purposes of explanation, various modifications thereof, after study of this specification, will be apparent to those skilled in the art to which the invention pertains.

What is claimed is:

1. In combination with an injector type liquid cooling system which comprises an air conduit open at both ends to the atmosphere, a plurality of liquid spray nozzles positioned near one end of the conduit and distributed over its cross-section, said nozzles being oriented to direct liquid sprays toward the other end of said conduit, said sprays intersecting to form a pumping or pressure region, liquid-air separator means positioned in said conduit near its said other end for intercepting the liquid sprayed by said nozzles and for causing said liquid to flow downwardly along said liquid-air separator means, a liquid collection sump positioned to collect liquid which flows down from the liquid-air separator means; an air slot with adjacent air-liquid separator means distributed over said slot downstream of said pressure or pumping region, said slot being arranged to allow air to escape from said conduit.

2. A combination according to claim 1 wherein the air-liquid separator means adjacent said slot comprises a plurality of parallel strips distributed over said slot.

3. A combination according to claim 2 wherein strips are formed with corrugations extending along their length to provide air-liquid separation.

4. A combination according to claim 2 wherein said slots are of generally rectangular cross-section.

5. A combination according to claim 1 wherein the slot and adjacent air-liquid separator means are at the top or at the sides of said conduit.

* * * * *